US011324297B2

(12) United States Patent
Fereyre et al.

(10) Patent No.: US 11,324,297 B2
(45) Date of Patent: May 10, 2022

(54) DEVICE FOR TREATING THE HAIR

(71) Applicants: L'OREAL, Paris (FR); SEB S.A., Ecully (FR)

(72) Inventors: Regis Fereyre, Lyons (FR); Baptiste Bonnemaire, Lyons (FR); Martial Maisonneuve, Villefontaine (FR); Vacheron Xavier, Genas (FR)

(73) Assignees: L'OREAL, Paris (FR); SEB S.A., Ecully (FR)

( * ) Notice: Subject to any disclaimer, the term of this patent is extended or adjusted under 35 U.S.C. 154(b) by 464 days.

(21) Appl. No.: 16/062,316

(22) PCT Filed: Dec. 16, 2016

(86) PCT No.: PCT/EP2016/081608

§ 371 (c)(1),
(2) Date: Jun. 14, 2018

(87) PCT Pub. No.: WO2017/103230

PCT Pub. Date: Jun. 22, 2017

(65) Prior Publication Data

US 2018/0360184 A1 Dec. 20, 2018

(30) Foreign Application Priority Data

Dec. 18, 2015 (FR) ..... 1562742

(51) Int. Cl.
*A45D 1/04* (2006.01)
*A45D 1/28* (2006.01)
(Continued)

(52) U.S. Cl.
CPC ..... *A45D 1/04* (2013.01); *A45D 1/28* (2013.01); *A45D 2/001* (2013.01);
(Continued)

(58) Field of Classification Search
CPC ... A45D 1/00; A45D 1/02; A45D 1/04; A45D 1/06; A45D 1/08; A45D 1/18; A45D 1/28;
(Continued)

(56) References Cited

U.S. PATENT DOCUMENTS 2,503,521 A * 4/1950 Stover ..... F16H 21/20 74/54
4,203,026 A * 5/1980 Walter ..... A45D 1/04 122/40
(Continued)

FOREIGN PATENT DOCUMENTS

KR 10-2015-0079776 A 7/2015
WO WO 2009/015027 A2 1/2009
(Continued)

OTHER PUBLICATIONS

Office Action dated Jun. 21, 2019 in corresponding Koreak Patent Application No. 10-2018-7016995 (with English Translation), 7 pages.
(Continued)

*Primary Examiner* — Rachel R Steitz
*Assistant Examiner* — Karim Asqiriba
(74) *Attorney, Agent, or Firm* — Oblon, McClelland, Maier & Neustadt, L.L.P.

(57) ABSTRACT

The invention relates to a device for treating the hair including a housing for receiving a cosmetic product refill, a heating element for the hair to be treated, and a device that prevents the reception of the cosmetic product refill in the housing, depending on the temperature of the heating element.

15 Claims, 4 Drawing Sheets

(51) Int. Cl.
*A45D 2/00* (2006.01)
*A45D 7/00* (2006.01)
*A45D 34/00* (2006.01)

(52) U.S. Cl.
CPC .. *A45D 2007/001* (2013.01); *A45D 2007/002* (2013.01); *A45D 2034/005* (2013.01)

(58) Field of Classification Search
CPC ..... A45D 2/00; A45D 2/001; A45D 2/002; A45D 2/005; A45D 2/06; A45D 2/12; A45D 2/28; A45D 2/30; A45D 2/40; A45D 2/42; A45D 2200/054; A45D 2007/00; A45D 2007/001; A45D 2007/002; A45D 2034/005; A45D 20/48; A46B 7/02; A46B 7/042; A46B 7/044
USPC ..... 15/176.1, 176.6, 202; 222/153.01, 147, 222/325; 219/221, 222, 225; 392/379, 392/383, 384, 385, 409, 410
See application file for complete search history.

(56) References Cited

U.S. PATENT DOCUMENTS 5,781,691 A * 7/1998 Kwok ..... A45D 1/04 132/228
7,341,064 B2 * 3/2008 Habibi ..... A45D 1/06 132/224
8,967,159 B1 * 3/2015 Jenkins ..... A45D 2/001 132/224
2004/0000319 A1 * 1/2004 Carballada ..... A45D 1/04 132/224
2005/0076930 A1 * 4/2005 Yuen ..... A46B 15/0024 132/132
2005/0236009 A1 * 10/2005 Park ..... A45D 1/18 132/224
2009/0025247 A1 1/2009 Yde et al.
2009/0032048 A1 * 2/2009 Suzuki ..... A45D 1/06 132/224
2011/0174331 A1 * 7/2011 Kim ..... A45D 1/06 132/229
2011/0220141 A1 * 9/2011 Chan ..... A45D 1/04 132/229
2012/0312320 A1 * 12/2012 Humphreys ..... A45D 1/28 132/211
2013/0146081 A1 * 6/2013 Chan ..... A45D 2/001 132/229
2013/0153461 A1 6/2013 Hein et al.
2013/0233335 A1 9/2013 Hein et al.
2013/0247407 A1 * 9/2013 Richmond ..... A45D 20/10 34/283
2013/0247933 A1 * 9/2013 Oh ..... A45D 2/002 132/269
2015/0034118 A1 2/2015 Hein et al.
2015/0289622 A1 10/2015 Fereyre et al.

FOREIGN PATENT DOCUMENTS

WO WO 2009/078046 A1 6/2009
WO WO 2013/045331 A1 4/2013
WO WO 2013/090896 A1 6/2013

OTHER PUBLICATIONS

International Search Report dated Feb. 24, 2017 in PCT/EP2016/081608 filed Dec. 16, 2016.
French Preliminary Search Report dated Aug. 19, 2016 in French application 1562742 filed Dec. 18, 2015.

* cited by examiner

DEVICE FOR TREATING THE HAIR

BACKGROUND

The present invention relates to a device for treating the hair, and more particularly, but not exclusively, to a device intended for shaping the hair, notably intended for straightening, curling or crimping the hair, comprising a cosmetic product refill.

The invention relates more particularly to a device comprising two jaws that are able to move with respect to one another and are able to take up a spaced-apart configuration for introducing a lock of hair between said jaws and a moved-together configuration for treating the lock, the jaws being movable along the lock in this moved-together configuration. In such a device, the jaws frequently carry two heating elements with which the hair of the lock is brought into contact during the use of the device.

Numerous devices of this type, sometimes also known as hair straighteners or straightening irons, have already been proposed.

Usually, hair straighteners consist of two arms that are connected together with the aid of a hinge which makes it possible to open and close the arms, and of at least one heating element disposed on the arms. During operations of styling a lock of hair, said lock is introduced between the two arms in the open position and then the two arms are closed manually over the lock of hair. The lock of hair is then subjected to the heat output by the heating element(s), until the two arms are opened and the lock of hair is removed.

The application WO-A-2009/078046 describes a hairstyling appliance comprising two arms that are connected together so as to allow the appliance to be opened and closed, at least one heating member and at least one seat for accommodating a hair treatment device, the latter allowing a haircare product to be dispensed during operation. The hair treatment device is composed of a support material impregnated with a haircare product. The hair treatment device is suitable for a single use.

WO-A-2009/015027 and US-A-2009/0025247 disclose a hair straightening device that makes it possible to apply a haircare product by contact with the hair. The haircare product to be applied is contained in a removable refill for the application thereof. Said removable refill comprises a reservoir containing the haircare product in a gelled form, and orifices for dispensing and applying the product, said orifices being made directly through a wall of the reservoir. The refill is introduced into a housing disposed on one of the two arms of the hair straightener, by sliding.

The application WO-A-2013/045331 likewise discloses an applicator for applying a care substance to the hair, comprising a cartridge of care substance held in a housing of the applicator. The cartridge comprises a porous support saturated with the care substance.

The application WO-A-2013/090896 relates to a hair treatment appliance, notably a hairstyling appliance, provided with a cartridge of treatment agent that can be removed. The cartridge of treatment agent substantially comprises a treatment agent holder, notably made of saturated porous material, to be applied to the hair or the skin, said holder being fastened to an accessory that forms a mechanical holder and a grip tab. The cartridge is mounted in a housing of the hair treatment appliance, said housing having a section complementary to the section of the cartridge of treatment agent.

According to one embodiment described in the application WO-A-2013/090896, the accessory is in the form of a needle passing through the cylindrical treatment agent holder. At its end away from the grip tab, the needle has a radially extending locking lug which is intended to engage with a complementary locking housing formed in the hair treatment appliance. The locking housing has a portion for the passage of the locking lug and a portion for blocking the locking lug in the longitudinal direction of the accessory in the form of a needle, in the direction of removal of the refill, this blocking portion being accessible by the locking lug, from the passage portion, by rotation of the cartridge about the axis of the accessory in the form of a needle. The cartridge is thus fixed in the housing by means of a bayonet-type locking system.

BRIEF SUMMARY

However, it has been found that these devices use up a large quantity of cosmetic product with an unsatisfactory output. Therefore, the aim of the present invention is to provide an improved device for treating the hair, which does not exhibit the drawbacks of the prior art devices.

To this end, the invention provides a device for treating the hair, comprising:

- a housing for receiving a cosmetic product refill,
- a heating element for the hair to be treated, and
- a device that prevents the reception of the cosmetic product refill in the housing, depending on the temperature of the heating element.

Such a device thus makes it possible to prevent the introduction of the cosmetic product refill into its housing as long as the temperature of the heating element is insufficient to allow satisfactory use of the device. Losses of cosmetic product by evaporation occurring during the increase in temperature of this heating element are thus avoided. A substantial saving of cosmetic product is achieved in this way, notably when the latter is water-based. The device for treating the hair according to the invention thus exhibits better output of the amount of cosmetic product applied to the hair compared with the amount of cosmetic product initially contained in the cosmetic product refill.

Such a device can also make it possible to fit the cosmetic product refill at a precise temperature at which the cosmetic product is very particularly effective.

Preferably, the device for treating the hair according to the invention has one or more of the following features, on their own or in combination:

- the device that prevents the reception of the cosmetic product refill in the housing comprises a lug that projects into the housing, the lug preferably being guided in translation in a passage formed in the device for treating the hair;
- the lug is guided in translation in a direction substantially perpendicular to the direction of insertion of the refill into the housing;
- the lug is guided in translation substantially in the direction of removal of the refill from the housing, such that, when the heating element cools, the lug ejects the refill from the housing;
- the device that prevents the reception of the refill in the housing comprises a bimetallic strip designed such that:
  - when the bimetallic strip is at a temperature below a first threshold temperature, the lug projects into the housing, and such that:

when the bimetallic strip is at a temperature above a second threshold temperature, the lug allows the introduction of the cosmetic product refill into the housing, the first threshold temperature preferably being greater than or equal to the second threshold temperature;

the bimetallic strip is fastened to the heating element so as to create a thermal connection between the heating element and the bimetallic strip;

the device that prevents the reception of the refill in the housing comprises a return spring for returning the lug into a position in which it allows the refill to be received in the housing, the bimetallic strip preferably preventing the return spring from moving the lug into the position in which it allows the cosmetic product refill to be received in the housing as long as the temperature of the bimetallic strip is below the first threshold;

an arm is secured to the bimetallic strip such that the arm projects from the device for treating the hair, at least in one of the positions of the bimetallic strip in which it allows or prevents the reception of the refill in the housing;

the device for treating the hair comprises two arms that are movable with respect to one another between a moved-together configuration for treating the hair and a spaced-apart configuration for introducing hair to be treated between said arms, one of the arms comprising the housing for receiving the cosmetic product refill and the heating element; and the device for treating the hair also comprises a cosmetic product refill, the cosmetic product refill comprising a reservoir that is intended to be at least partially received in the housing and an applicator member in fluidic communication with the reservoir, the applicator member being intended to extend at least partially out of the housing.

BRIEF DESCRIPTION OF THE DRAWINGS

The invention may be better understood from reading the following detailed description of non-limiting exemplary embodiments thereof and from examining the appended drawing, in which.

DETAILED DESCRIPTION

In the rest of the description, identical or similar elements bear the same reference signs in the figures. In order to make the present description concise, these identical or similar elements are not described in detail in each example in which they appear, only the differences being described.

Figure 1:
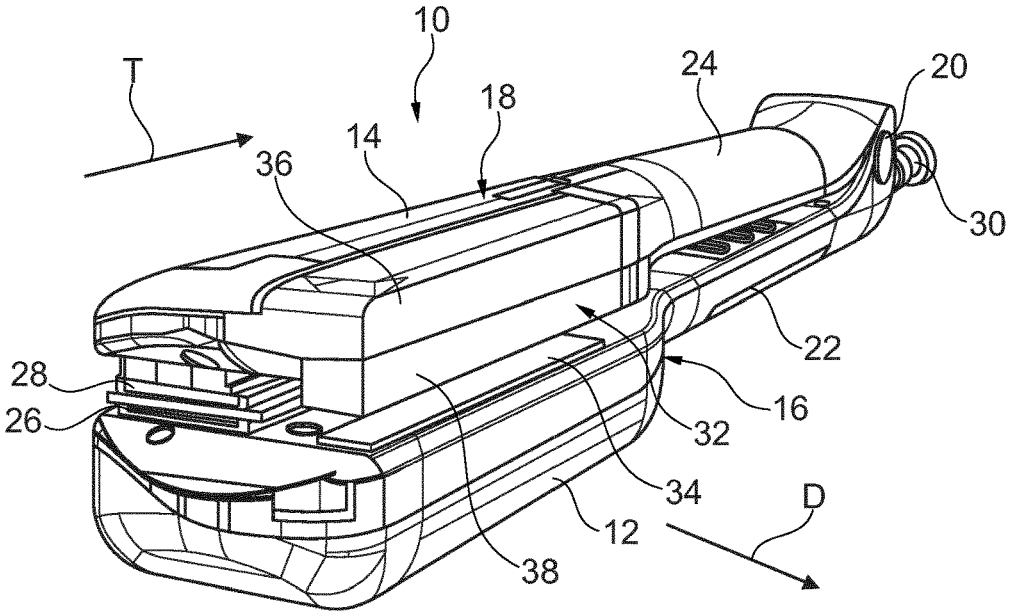
FIG. 1 is a schematic perspective view of one example of a device.
Figure 2:
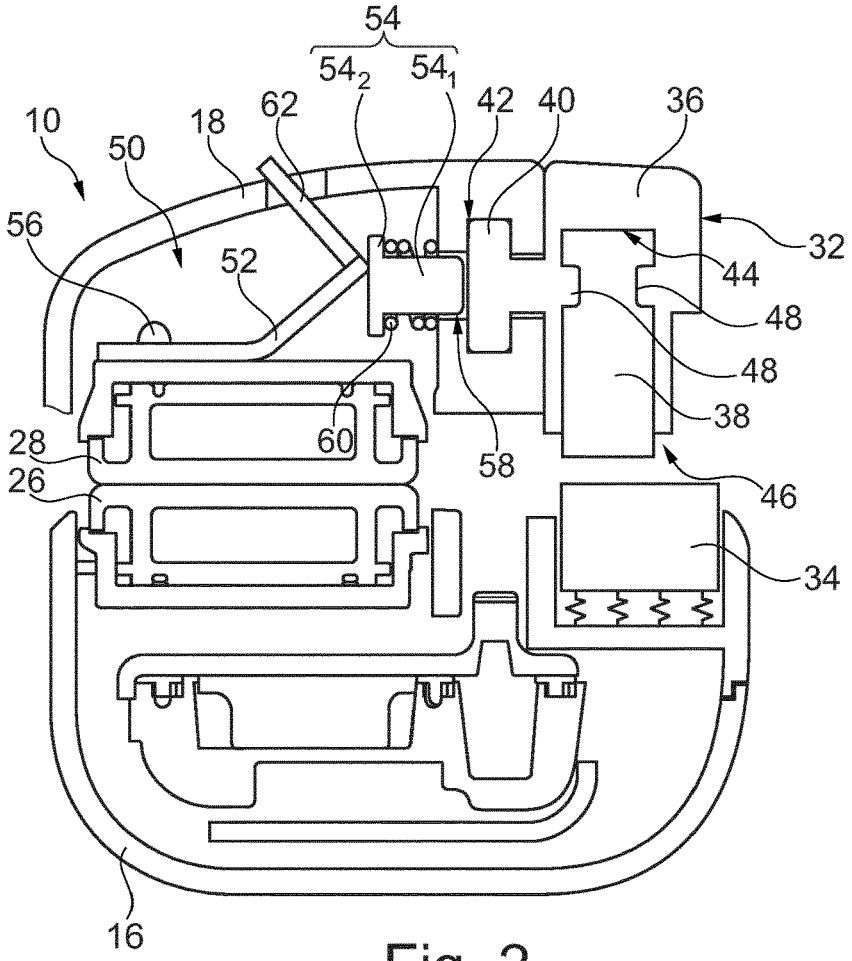
FIG. 2 is a cross section through FIG. 1.

A handpiece 10 of one example of a device for treating the hair is shown in FIGS. 1 and 2. The illustrated device for treating the hair is for example a straightener having flat heating elements, which notably come into contact in the closed position.

The handpiece 10 has two jaws 12, 14 that are able to move with respect to one another between a spaced-apart configuration (not shown) for the introduction between said jaws of a lock of hair, and a moved-together configuration for treating the lock of hair.

The jaws 12, 14 are carried by a lower arm 16 and an upper arm 18, respectively. The lower arm 16 and upper arm 18 are, in the example in question, hinged with respect to one another by means of a hinge pin 20, the handpiece 10 thus forming tongs.

The lower arm 16 and upper arm 18 in this case each have a total length of between 22 cm and 37 cm, notably 31 cm. The lower arm 16 and upper arm 18 define, between the hinge pin 20 and the jaws 12, 14, respective half-handles 22, 24 on which the user can press in order to move the jaws 12, 14 together.

An elastic return member (not visible) can be provided to return the jaws 12, 14 into the spaced-apart configuration. This elastic return member can be in the form of a spring disposed around the hinge pin 20 of the lower arm 16 and upper arm 18.

Of course, the jaws 12, 14 can be rendered movable with respect to one another in some other way. They can notably be movable with respect to one another not by rotation, as is the case with a hinge, but by movement in translation. However, preference is given to the ergonomics provided by a hinge.

The jaws 12, 14 define between one another a region for treating the hair, said region being intended to receive a lock of hair to be treated, the handpiece 10 being moved along said lock during the treatment. The handpiece 10 is moved for example in the direction from the root to the tip of the hair of the lock, in the direction D shown in FIG. 1.

Figure 3:
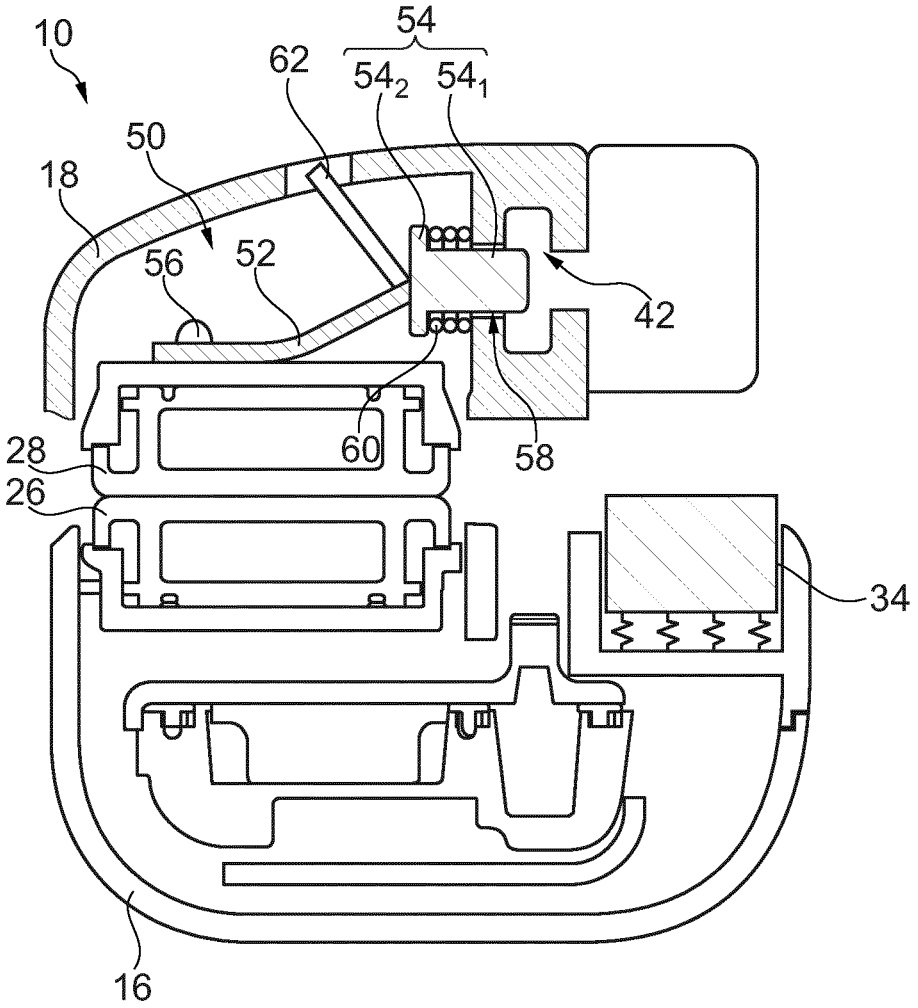
FIG. 3 is a view similar to FIG. 2, no cosmetic product refill being mounted in the device.

In the example in FIGS. 1 to 3, the handpiece 10 makes it possible to apply a cosmetic product for carrying out a treatment of the hair by way of steam, and then to carry out a thermal treatment of the hair by contact with a heated surface of two heating elements 26, 28 for the hair that are respectively carried by each of the jaws 12, 14.

The direction D of movement of the handpiece 10 over the hair, illustrated in FIG. 1, is preferably substantially perpendicular to the median axis of the upper arm 16 and lower arm 18, that is to say substantially parallel to the hinge pin 20.

In the example illustrated, the handpiece 10 is connected by a line 30 to a base station (not shown) that is fixed during the treatment and is itself connected to the mains. This base station provides the electric power supply to the handpiece 10 and also its supply with water in order to generate steam. The base station can also carry out additional functions of processing electrical signals received from the handpiece 10. The line 30 which connects the handpiece 10 to the base station can thus comprise various electrical conductors and a water supply pipe.

A user interface (not shown in the figures) can also be present on the handpiece 10, for example so as to allow the user to start up certain components thereof, or not.

The cosmetic product is applied by a refill 32 (or cartridge) carried by one of the two arms 16, 18, in this case the upper arm 18, which comes into contact with a pressing element 34 carried by the other arm, in this case the lower arm 16. The pressing element 34 is received, in a removable manner, in a housing formed in the lower arm 16. The pressing element 34 is movable in its housing. The refill 32 is received in a housing formed in the upper arm 18, with an elongate shape in the direction of insertion of the refill.

The arm opposite the one on which the refill 32 is disposed may have a steam outlet, and preferably also a comb (not shown).

The heating element(s) 26, 28 may each comprise a plate made of a material that is a good conductor of heat, defining a hot surface for bringing into contact with the hair, the temperature of said surface being for example greater than or equal to 95° C., better still between 90 and 230° C.

Preferably, cosmetic product is applied to the lock of hair introduced into the device before the application of steam and/or straightening by the heating element(s) and after combing. Thus, the hair introduced between the arms can come into contact with the applicator member before being exposed to the steam and to the heating elements while the lock is being moved between the arms of the device.

The refill 32 comprises a body 36 and an applicator member 38 received in the body 36 such that, when the refill 32 is fastened to the appliance 10, the applicator member 38 is able to come into contact with the hair extending through the treatment region.

The body 36 has a recess 44 that opens towards the outside by way of an opening 46 that receives the applicator member 38. More specifically, the applicator member projects from the recess 44 in order to be able to be in contact with a lock of hair to be treated.

The body 36 of the refill 32 may comprise coupling reliefs 48 that project into the recess 44 and keep the applicator member 38 in position in the recess 44, even during the application of the cosmetic product to the lock of hair.

The coupling reliefs 48 may be moulded together with the body 36. The latter 36 and the coupling reliefs 48 may notably be made of thermoplastic material, notably polybutylene terephthalate (PBT), polyethylene terephthalate (PET), polyamide (PA), elastomer or a mixture thereof, in particular a mixture of PBT and PET.

The applicator member 38 is made for example of a porous material, notably of synthetic or natural fibres that are all oriented substantially in the same direction and moulded to form a felt. The applicator member 38 is impregnated with product.

The refill 32 may be connected to either of the lower arm 16 or upper arm 18 (in this case the upper arm 18). The refill 32 is connected to the arm 18 which receives it in a housing provided to this end, by any means. Notably, as illustrated in FIG. 2, the refill 32 is received by sliding a rib 40 of the body 36 into a groove 32 of complementary section formed in the arm 18, in a direction T of insertion of the refill 32 into its housing. The rib 40 and the groove 42 in this case have a "T"-shaped cross section. The connection between the rib 40 and the groove 42 ensures a predefined relative position of the refill 32 with respect to the arm 18, notably with respect to the direction D of movement of the handpiece 10. In a variant, the rib may be formed on the arm 18 and the groove in the body 36.

In this case, the direction T of insertion of the refill 32 is substantially parallel to a longitudinal direction of the device for treating the hair. The housing is open onto a front surface of the device for treating the hair, said surface being transverse to the direction T of insertion of the refill 32.

The appliance may additionally comprise any device for locking the connection between the refill 32 and the arm 18. For example, the refill 32 may be snap-fastened to the arm 18 of the device for treating the hair. Notably, the refill 32 may be provided with a male part of a locking device of the push-push type, the arm 18 being provided with a corresponding female part of a locking device of the push-push type.

A locking device of the push-push type is understood to be a system that allows:

- a male element to be locked with respect to a female element by a simple relative movement in translation of the male element with respect to the female element in one direction and one sense, and
- the male element to be unlocked with respect to the female element by a relative movement in translation of the male element with respect to the female element in the same direction and the same sense.

For example, the male element can be locked and unlocked in this case by being pressed in a direction and a sense that are directed towards the female element. Here, this direction is the same as the direction T of insertion of the refill 32 into its housing.

Preferably, the locking and unlocking consist of a push on the male element in one and the same direction and one and the same sense, without any other manipulation or any other relative movement of the male element with respect to the female element.

Locking of a male element with respect to a female element is understood as meaning that a relative movement of the male element with respect to the female element is impossible, or at least prevented by the locking system. Such a system can be used alone in order to connect the refill to the arm. However, in order to ensure better stability of the connection of the refill to the arm, it is preferred to also employ a connecting device in addition to the locking device. In this case, this is the engagement of the rib 40 and the groove 42.

Such a push-push locking device provides great ease of locking and unlocking of the connection of the refill 32 to the handpiece 10 compared with the devices known from the prior art.

Preferably, the male element—the more simple element—is incorporated into the body of the refill, and the female element—which is more complex—is integrated into the arm of the device in order to reduce the manufacturing costs of the refills. However, the reverse configuration (male element on the arm of the device, female element on the refill) is also conceivable.

Moreover, as is illustrated in FIGS. 2 and 3, the appliance 10 comprises a device 50 that can prevent the reception of the cosmetic product refill 32 in its housing, depending on the temperature of the heating element 28.

This device 50 in this case comprises a bimetallic strip 52 that bears at one end against a lug 54.

The bimetallic strip 52 is constituted of two strips of different metals or alloys that are flexible and welded or adhesively bonded together in the lengthwise direction. These two strips of metal can be welded by cold rolling. By way of example, one of the strips can be made of invar and the other of the two strips of nickel. In both cases, the two strips have different coefficients of expansion such that the bimetallic strip deforms depending on its temperature. In the embodiment described, the bimetallic strip 52 can deform between two end positions that are illustrated in FIGS. 2 and 3, respectively:

- in FIG. 2, the hot bimetallic strip 52 is deformed such that the lug 54 cannot project into the groove 42, thereby allowing the reception of the cosmetic product refill 32 in its housing;
- in FIG. 3, the cooled bimetallic strip has a shape such that the lug 54 can project into the groove 42, thereby preventing the complete reception of the cosmetic product refill 32 in its housing and/or the locking thereof.

Advantageously, the deformation of the bimetallic strip during an increase in its temperature takes place when a first temperature threshold has been exceeded, its reverse deformation taking place when the temperature drops below a second threshold again, said second threshold being lower than the first threshold.

In this case, the bimetallic strip 52 is fastened to the heating element 28 disposed in the arm that receives the cosmetic product refill 32. The bimetallic strip 52 can be fastened with the aid of a screw 56. The screw thus forms a thermal connection between the heating element 28 and the bimetallic strip 52, allowing the latter to be heated when the temperature of the heating element 28 increases.

Of course, other means of fastening the bimetallic strip 52 to the heating element 28 can be provided. For example, the bimetallic strip 52 can be welded, crimped or adhesively bonded to the heating element 28 or fastened thereto by matching shapes.

The lug 54, the movement of which is controlled by the deformations of the bimetallic strip 52, is in this case guided in translation in a passage 58 formed in the body of the arm 18. The passage 58 leads out, as illustrated, into the groove 42 that receives the rib 40 formed on the body 38 of the refill 32. To this end, the passage 58 has in this case a section substantially complementary to that of a first portion 541 of the lug 54. The first portion 541 has a smaller cross section than a second portion 542 of the lug. For example, the passage 58 has a substantially cylindrical shape, the axis of which is perpendicular to the direction T of insertion of the cosmetic product refill 32 into the housing. In this case, the axis of the passage 58 is substantially parallel to the direction D of treatment of the hair. In a variant, the direction of movement of the lug 54 in the passage 58 can be perpendicular both to the direction T of insertion of the refill into the housing and to the direction D of treatment of the hair.

Since the lug 54 is guided in translation in the passage 58 in a direction perpendicular to the direction of insertion of the refill 32, it is possible to ensure that the cosmetic product refill cannot be force-fitted into the housing counter to a force exerted by the bimetallic strip 52, deforming the latter.

It should be noted that a return spring 60 is provided, in the example illustrated, in order to keep the lug 54 outside the groove 42 while the device is being used, when the bimetallic strip 52 is hot. The return spring 60 in this case bears against both the edge of the passage 58 and the widened portion 542 of the lug 54.

Finally, as illustrated, the bimetallic strip 52 is joined to a safety indicator for visually indicating to the user of the device that the latter is hot or cold. To this end, an arm 62 is secured to the bimetallic strip 52 such that the arm 62 projects from the device for treating the hair in the configuration of the bimetallic strip in which it allows the introduction of the refill 32. Thus, when the end of the arm 62 projects from the appliance, the user knows that the heating element 28 is hot. If this is not the case, they know that the device is cold.

As indicated above, in FIG. 2, the appliance 10 is shown in operation. The heating element 28 is at its nominal temperature or close to its nominal temperature, allowing the treatment of the hair. This nominal temperature can be between 90 and 230° C. and may notably be equal to 95° C. Under these conditions, the bimetallic strip 52 is deformed such that the lug 54 does not project into the groove 42. The housing can then receive the refill 32. The arm 62 projects from the device 10, indicating to the user that said device is hot.

In FIG. 3, by contrast, the heating element 28 is not at its nominal temperature allowing treatment of the hair. In this case, as illustrated, the bimetallic strip 52 is in a configuration such that the lug 54 which is bearing against the latter projects into the groove 42. Under these conditions, it is not possible to fit the cosmetic product refill 32 into its housing. At least, it is not possible to insert the refill 32 into its use position in which it is completely received in the housing. The appliance cannot be used properly. In this position, the arm 62 does not project from the device. The user is thus informed that the device is cold.

Figure 4:
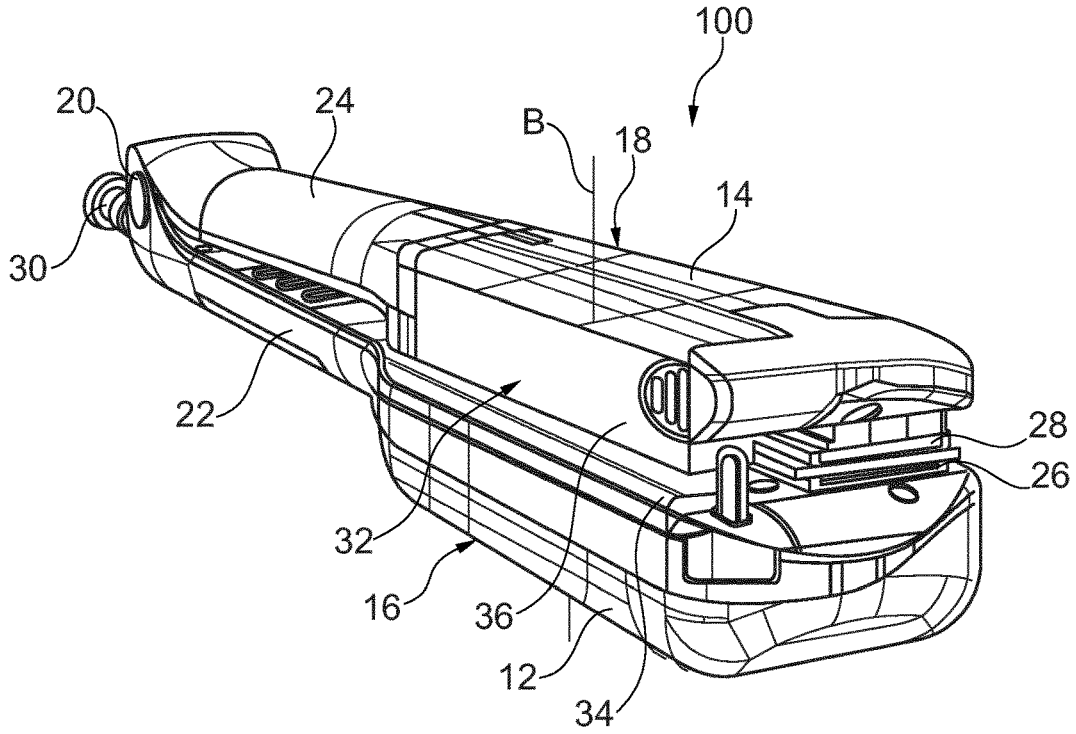
FIG. 4 shows a schematic perspective view of another example of a device.
Figure 5:
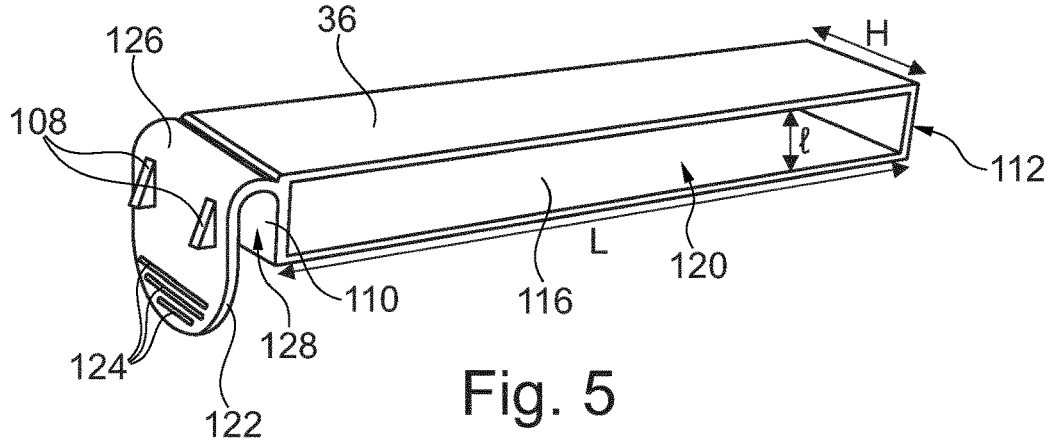
FIGS. 5 and 6 are two depictions at different perspectives of a cartridge body that can be employed in the device from FIG. 4.
Figure 6:
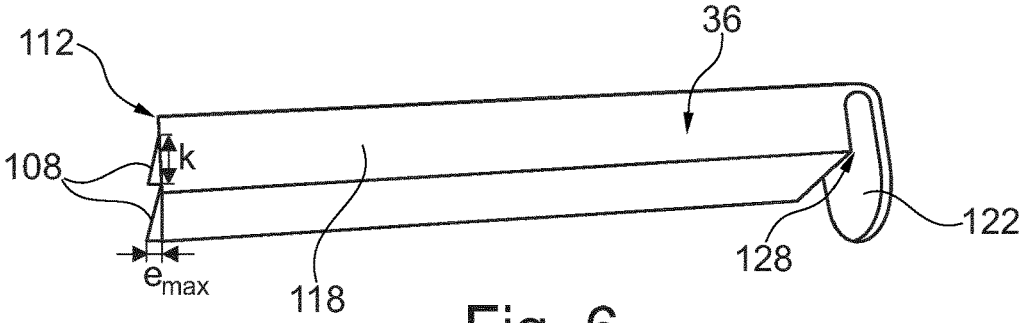

FIG. 4 illustrates a second example 100 of a device for treating the hair. This device 100 differs from the device 10 according to the first example described essentially by the fastening of the cosmetic product refill 32 to the arm 18. In this case, the cosmetic product refill is received in its housing by one of its ends being inserted into the housing, and then by the cosmetic product refill being pivoted.

As illustrated, the cosmetic product refill 32 is received in a housing in the upper arm 18 that is delimited by two surfaces normal to the longitudinal direction of the arm, namely a front surface and a rear surface that are connected together by a lateral surface. The housing is also open at least towards the lower arm 16 and towards the outside.

The cosmetic product refill 32 comprises a body 36 provided with coupling reliefs 108 for fixing the refill 32 in its housing.

The body 36 has the overall shape of a right-angled parallelepiped. The body 36 is elongate in a longitudinal direction and has a "U"-shaped cross section.

The body 36 comprises two opposite walls 110, 112, namely a front wall 110 and a rear wall 112, that are connected by two side walls 114, 116 and by a bottom 118.

The body 36 has a length L, measured between the front wall 110 and the rear wall 112, of for example between 70 and 100 mm, a height H, measured from the opening 120 to the bottom 118, of for example between 10 and 30 mm, and a width 1, measured perpendicularly to the length L and to the height H, of for example between 5 and 20 mm.

The rear wall 112 comprises at least one coupling relief 108, in this case two coupling reliefs 108. These two coupling reliefs 108 project from the rear wall 112. The coupling reliefs 108 in this case have an asymmetric shape. The coupling reliefs 108 have for example a substantially triangular shape in side view.

The coupling reliefs 108 on the rear wall are centred on this rear wall 112 and have a maximum thickness $e_{max}$, measured from the rear wall 112, of for example between 0.2 and 5 mm, in this case substantially equal to 1 mm, and a length k of for example between 4 and 10 mm. The coupling reliefs 108 on the rear wall 112 are for example spaced apart by a distance of between 1 and 10 mm.

The rear wall 110 has an elastically deformable tab 122 that has at least one projecting coupling relief 108, in this case two projecting coupling reliefs 108, and gripping reliefs 124.

The tab 122 is connected to the front wall 110 by way of a rounded portion 126 forming a groove 128 therewith. The tab 122 extends parallel to the front wall 110 and is spaced apart from the latter by a distance of between 1 and 5 mm.

The coupling reliefs 108 on the surface of the tab 122 that is oriented towards the outside have a shape substantially identical to that of the coupling reliefs 108 on the rear wall 112 of the body 36 of the refill. They are also disposed on the surface of the tab in a similar manner to the disposition of the coupling reliefs 108 on the rear wall 112 of the body 36 of the refill.

The gripping reliefs 124 are in this case realized in the form of three parallel ribs.

The refill 32 is fitted in its housing as follows:

- the user introduces the rear wall 112 of the refill 32 into the housing, through the open lateral part of the housing, facing a rear surface of the latter;
- the coupling reliefs 108 on the rear wall 112 of the body 36 of the refill are then next to the complementary recessed reliefs, not shown, in the rear surface of the housing;
- the user then pivots the refill 32 about a pivot axis B, shown in FIG. 4, in order to put it into the use position in the housing 22. In doing so, the coupling reliefs 108 on the rear wall 112 of the body 36 are received in the complementary recessed reliefs in the rear surface of the housing, and the coupling reliefs 108 on the tab 122 are snap-fastened into complementary recessed reliefs (not shown) in the front surface of the housing. The insertion of the coupling reliefs 108 on the tab 122 into complementary recessed reliefs in the housing is made possible by elastic deformation of the tab 122 during the pivoting of the body 36. The coupling reliefs 108 received in the complementary recessed reliefs in the housing keep the refill 32 in position in the housing.

Figure 7:
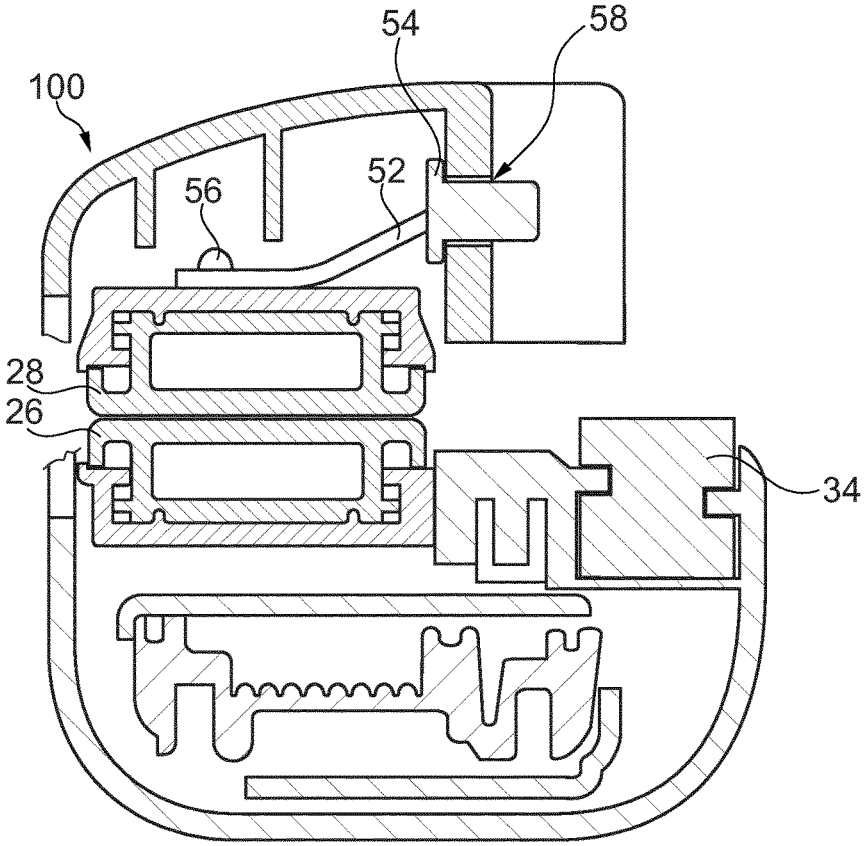
FIG. 7 is a cross section through the device from FIG. 4 without a cosmetic product refill.

However, as is visible in FIG. 7, notably, the reception of the refill 32 in its housing is only possible when the lug 54 does not project into this housing. Thus, as explained with regard to the first example of a device for treating the hair 10, the insertion of the refill 32 is only possible when the bimetallic strip 52 is deformed by the heat emitted by the heating element 28, having reached its nominal operating temperature. As long as this temperature has not been reached, the bimetallic strip 52 keeps the lug 54 projecting into the housing, such that the coupling reliefs 108 on the body 32 cannot be inserted correctly into the complementary recessed reliefs formed in the front and rear surfaces of the housing.

In order to remove the refill 32, the user presses, in the direction of the rear of the refill 32, on the end part of the tab 122 projecting from the housing, while pivoting the refill 32 about its pivot axis B. Pressing on the tab 122 makes it possible to curve the latter and thus to disengage the coupling reliefs 108 on the tab 122 from the complementary recessed reliefs in the front surface of the housing. Pivoting the refill 32 makes it possible to take the front part of the refill 32 out of its housing and to disengage the coupling reliefs 108 on the rear wall 112 of the body 36 from the complementary recessed reliefs formed in the rear surface of the housing. The user can then easily remove the refill 32 from its housing.

Figure 8:
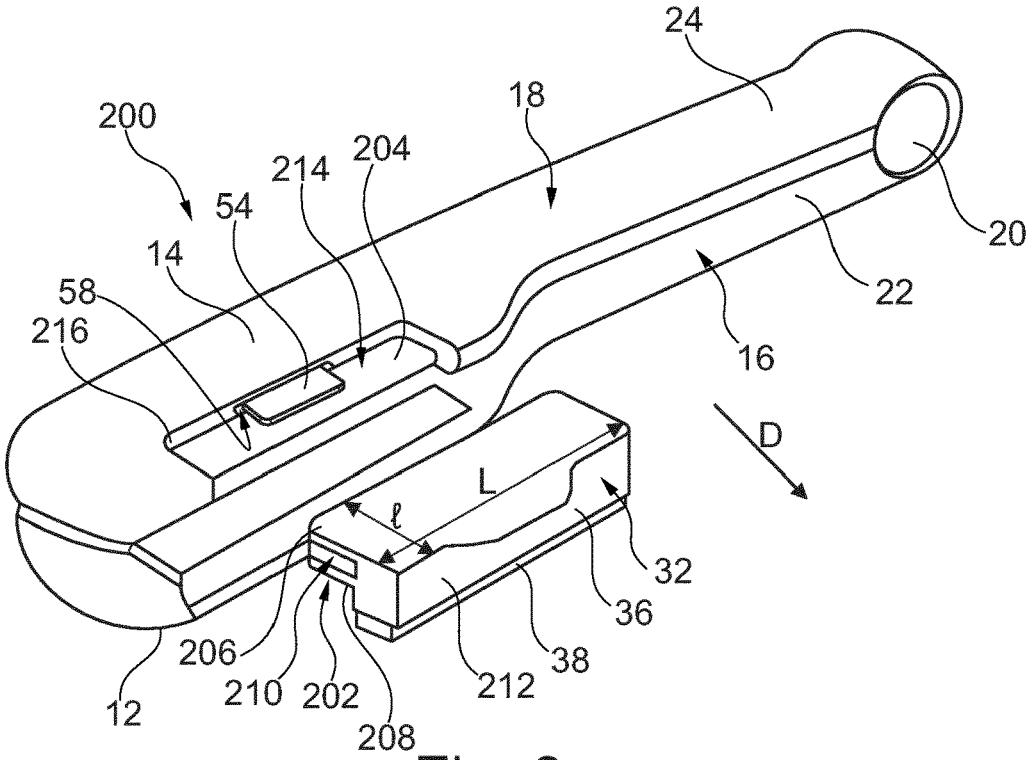
FIG. 8 is a perspective view of a third example of a device for treating the hair, from which the refill has been removed.

FIG. 8 illustrates a third example of a device 200 for treating the hair. This device 200 differs from the devices 10 and 100 essentially by the manner of fastening the cosmetic product refill 32 to the arm 18. Specifically, in the case of the example in FIG. 8, the cosmetic product refill is fastened in its housing by sliding in a transverse direction with respect to the device for treating the hair; this direction is in this case substantially parallel to the direction D of movement of the device for treating the hair during use.

To this end, in the example illustrated in FIG. 8, the refill 32 comprises a clip 202 that is designed to engage with a strip 204 secured to the upper arm 18 or formed by this upper arm 18, in order to fasten the refill 32 to the upper arm 18.

The clip 202 is in this case formed by two walls 206, 208 which extend in parallel along the entire length L of the refill 20. The two walls 206, 208 are separated for example by a space 210 between one another, said space having a thickness of for example between 0.5 mm and 10 mm, better still between 1 mm and 5 mm. The width e of the walls 206, 208, measured from the lateral surface 212 of the refill 32, at the free end of said walls 206, 208, is in this case constant. This width is for example between 0.5 mm and 50 mm, better still between 2 mm and 30 mm.

Moreover, the strip 204 is formed at a recess 214 in the upper arm 18, dimensioned to receive the refill 32. The strip 204 thus extends in the recess 214. The strip 204 has a constant thickness, substantially equal to or slightly greater than the thickness of the space 210 between the walls 206, 208 of the refill 32. The strip 204 is intended to be received in the space 210 when the refill 32 is received in the recess 214 forming the housing for receiving the refill 32.

The refill 32 is introduced into the housing by way of a movement along an axis substantially parallel to the hinge pin 20 or to the direction D of movement of the device for treating the hair during its use. The walls 206, 208 slide on either side of the strip 204 until the refill 32 butts against the bottom 216 of the recess 214 and/or until the strip 204 butts against the end of the space 210 defined between the two walls 206, 208. The refill 32 can be kept in position by friction of the inner surfaces of the walls 206, 208 against the upper and lower surfaces of the strip 204. The positioning of the refill 32 in the recess 214 along the longitudinal axis of the arm 18 is ensured by the contact between front and rear surfaces of the refill 32 and front and rear surfaces of the recess 214.

However, a lug 54, in this case in the form of a tongue, extends substantially parallel to the strip 204, in the recess 214. This lug is for example secured to a bimetallic strip thermally connected to the heating element received in the upper arm, as in the devices 10, 100 described above. When the bimetallic strip is cold, the lug 54 projects into the recess 214, preventing the insertion of the refill 32 into the recess 214. This is because, in this case, the combined thickness of the strip 204, of the lug 54 and of the space between the strip 204 and the lug 54, as the case may be, is greater than the thickness of the space 210 between the two walls 206, 208, such that the refill cannot slide along the strip 204 in order to be completely received in the housing 214.

It should be noted here that the lug 54 is guided in translation substantially in the direction of removal of the cosmetic product refill 32 from its housing. In this case, the cooling of the heating element can advantageously cause the removal of the cosmetic product refill 32 without requiring any action on the part of the user.

The invention is not limited to the exemplary embodiments that have just been described, but can be varied in numerous ways.

Thus, the bimetallic strip can exhibit binary actuation—that is to say have two stable positions—or progressive actuation—that is to say it can take up different stable positions between two end positions.

Furthermore, as indicated above with regard to the example in FIGS. 1 to 3, the bimetallic strip can be joined to a safety indicator in order to visually indicate to the user that the appliance is hot or cold. To this end, an arm is for example secured to the bimetallic strip such that the arm projects from the device for treating the hair, at least in one of the positions of the bimetallic strip in which it allows or prevents the introduction of the cosmetic product refill into the housing. Thus, when the end of the arm projects from the appliance, the user knows that the heating element is hot or cold, depending on the scenario. In a variant, the end of the arm can also project from the device regardless of the temperature of the heating element. In this case, the end of the arm that projects can be moved between two end positions on account of the deformation of the bimetallic strip. One of these positions corresponds to a minimum temperature of the bimetallic strip and the other to a maximum temperature, preferably the nominal temperature. The position of the arm and of its end projecting from the device for treating the hair then depends on the temperature of the heating element, between these two extreme values. The user can then be informed that the device is ready to use, the heating element having reached its nominal temperature.

Moreover, in the examples presented, a lug projects into the housing for receiving the cosmetic product refill. In a variant, a flap that is secured to the bimetallic strip such that the flap closes the housing, preventing access to the refill, depending on the temperature of the heating element, notably as long as the heating element has not reached its nominal temperature.

Finally, even though an embodiment having a bimetallic strip appears to be preferable on account of its ease of manufacturing and its low cost, it may be replaced by very different devices. For example, a temperature sensor that is designed to measure the temperature of the heating element, an electric motor for moving the lug, the flap or any other component used to prevent the reception of the cosmetic product refill in its housing, and an electronic control unit connected to the temperature sensor and to the electric motor, for controlling the actuation of the motor depending on the temperature measured by the temperature sensor, may be employed. Also in this case, the motor or a second motor may be employed to move the arm indicating the temperature of the heating element.

Also in this case, two different threshold temperatures can be implemented that control the actuation of the motor in one direction for a rise in temperature of the heating element and in the other direction for a drop in temperature of the heating element, in order to ensure stable operation of the device for treating the hair.

The invention claimed is:

1. A device for treating the hair, comprising:

a housing for receiving a cosmetic product cartridge, the cosmetic product cartridge comprising a body containing a cosmetic product;

a heating element for the hair to be treated; and a protruding element that mechanically prevents the reception of the cosmetic product cartridge in the housing, depending on a temperature of the heating element.

2. The device for treating the hair according to claim 1, wherein the protruding element that mechanically prevents the reception of the cosmetic product cartridge in the housing includes a lug that projects into the housing.

3. The device for treating the hair according to claim 2, wherein the lug is guided in translation in a direction substantially perpendicular to the direction of insertion of the cosmetic product cartridge into the housing.

4. A device for treating the hair, comprising:

a housing for receiving a cosmetic product cartridge;

a heating element for the hair to be treated; and a protruding element that mechanically prevents the reception of the cosmetic product cartridge in the housing, depending on a temperature of the heating element, wherein the protruding element that mechanically prevents the reception of the cosmetic product cartridge in the housing includes a lug that projects into the housing, and wherein the lug is guided in translation substantially in the direction of removal of the cosmetic product cartridge from the housing, such that, when the heating element cools, the lug ejects the cosmetic product cartridge from the housing.

5. A device for treating the hair, comprising:

a housing for receiving a cosmetic product cartridge;

a heating element for the hair to be treated; and a protruding element that mechanically prevents the reception of the cosmetic product cartridge in the housing, depending on a temperature of the heating element, wherein the protruding element that mechanically prevents the reception of the cosmetic product cartridge in the housing includes a lug that projects into the housing, and wherein the protruding element that mechanically prevents the reception of the cosmetic product cartridge in the housing includes a bimetallic strip designed such that:

when the bimetallic strip is at a temperature below a first threshold temperature, the lug projects into the housing, and such that:

when the bimetallic strip is at a temperature above a second threshold temperature, the lug allows the introduction of the cosmetic product cartridge into the housing.

6. The device for treating the hair according to claim 5, wherein the bimetallic strip is fastened to the heating element so as to create a thermal connection between the heating element and the bimetallic strip.

7. The device for treating the hair according to claim 5, wherein the protruding element that mechanically prevents the reception of the cosmetic product cartridge in the housing includes a return spring for returning the lug into a position in which it allows the cosmetic product cartridge to be received in the housing.

8. The device for treating the hair according to claim 5, wherein an arm is secured to the bimetallic strip such that the arm projects from the device for treating the hair, at least in one of the positions of the bimetallic strip in which it allows or prevents the reception of the cosmetic product cartridge in the housing.

9. The device for treating the hair according to claim 1, further comprises two arms that are movable with respect to one another between a moved-together configuration for treating the hair and a spaced-apart configuration for introducing hair to be treated between said arms, one of the arms including the housing for receiving the cosmetic product cartridge and the heating element.

10. The device for treating the hair according to claim 1, wherein the body of the cosmetic product cartridge includes a reservoir and receives an applicator member in fluidic communication with the reservoir, the applicator member being intended to extend at least partially out of the housing.

11. The device for treating the hair according to claim 2, wherein the lug is guided in translation in a passage formed in the device for treating the hair.

12. The device for treating the hair according to claim 5, wherein the first threshold temperature is greater than or equal to the second threshold temperature.

13. The device for treating the hair according to claim 7, wherein the bimetallic strip prevents the return spring from moving the lug into the position in which it allows the cosmetic product cartridge to be received in the housing as long as the temperature of the bimetallic strip is below the first threshold.

14. The device for treating the hair according to claim 1, wherein the housing is configured to fasten the body of the cosmetic product cartridge.

15. The device for treating the hair according to claim 14, wherein the housing comprises means to fasten the body of the cosmetic product cartridge in the housing that are configured to cooperate with corresponding means of the body of the cosmetic product cartridge.

* * * * *